US008650695B2

(12) United States Patent
Pruett et al.

(10) Patent No.: US 8,650,695 B2
(45) Date of Patent: Feb. 18, 2014

(54) PIPELINE CLEANING PIG WITH SELF-ENERGIZING DIAGONALLY ORIENTED SCRAPERS

(75) Inventors: Rick D. Pruett, Oologah, OK (US); William J. Rankin, Sapulpa, OK (US)

(73) Assignee: TDW Delaware Inc., Wilmington, DE (US)

( * ) Notice: Subject to any disclaimer, the term of this patent is extended or adjusted under 35 U.S.C. 154(b) by 262 days.

(21) Appl. No.: 12/355,133

(22) Filed: Jan. 16, 2009

(65) Prior Publication Data

US 2010/0180391 A1 Jul. 22, 2010

(51) Int. Cl.
*B08B 9/04* (2006.01)

(52) U.S. Cl.
USPC ..... 15/104.061; 15/104.062; 134/8

(58) Field of Classification Search
USPC ..... 15/104.061, 104.06, 104.05, 104.09, 15/104.16, 246.5
IPC ..... B08B 9/04,9/45, 9/47, 9/55
See application file for complete search history.

(56) References Cited

U.S. PATENT DOCUMENTS

| | | | | |
|---|---|---|---|---|
| 3,262,143 | A * | 7/1966 | Reinhart | 15/104.061 |
| 3,576,043 | A | 4/1971 | Zongker | |
| 4,081,875 | A | 4/1978 | Nishino | |
| 4,083,074 | A | 4/1978 | Curtis | |
| 4,244,073 | A | 1/1981 | Sagawa | |
| 4,538,316 | A * | 9/1985 | Reinhart et al. | 15/104.061 |
| 4,603,449 | A | 8/1986 | Knapp | |
| 4,726,089 | A * | 2/1988 | Knapp | 15/104.061 |
| 4,907,314 | A | 3/1990 | Kershaw | |
| 5,379,475 | A | 1/1995 | Sivacoe | |
| 5,384,929 | A | 1/1995 | Smith | |
| 5,457,841 | A | 10/1995 | Minton | |
| 5,600,863 | A | 2/1997 | Curran | |
| 5,903,946 | A * | 5/1999 | Collins et al. | 15/104.061 |
| 6,038,725 | A | 3/2000 | Knapp | |
| 6,065,174 | A | 5/2000 | Laymon | |
| 6,145,150 | A | 11/2000 | Knapp | |

(Continued)

FOREIGN PATENT DOCUMENTS

GB 1423132 A 1/1976

OTHER PUBLICATIONS

International Search Report and Written Opinion, issued by the International Searching Authority (ISA/US) on Mar. 8, 2010 (PCT/US10/20451); 8 pages.

*Primary Examiner* — Monica Carter
*Assistant Examiner* — Stephanie Berry
(74) *Attorney, Agent, or Firm* — Gable Gotwals

(57) ABSTRACT

The present invention is a pipeline pig for cleaning the interior of a pipeline, the pipeline pig having a longitudinal pig body with forward and rearward elastomeric propulsion members affixed to and supporting the pig body substantially concentrically in a pipeline, the propulsion members functioning to move the pig body through a pipeline by the force of fluid flow and a plurality of spaced apart elastomeric diagonally oriented scrapers radially extending from the pig body, each scraper member having a semi-circular outer peripheral edge configured and dimensioned to engage the interior wall of a pipeline to thereby scrape and clean the interior pipeline wall as the pig is moved through the pipeline and provide additional support for the pig substantially concentrically in a pipeline. Orientation of the scraper enhances scraping effectiveness by slicing through any debris buildup, separating the debris from the inner pipe wall so that it can be pushed out of the pipeline by the pig discs or cups.

20 Claims, 5 Drawing Sheets

(56) References Cited

U.S. PATENT DOCUMENTS

| | | | | |
|---|---|---|---|---|
| 6,276,017 | B1 | 8/2001 | Lino et al. | |
| 6,308,363 | B1 | 10/2001 | Lino et al. | |
| 6,792,641 | B1 | 9/2004 | Laker | |
| 7,000,280 | B1 | 2/2006 | Knapp | |
| 7,386,908 | B2 | 6/2008 | Lino et al. | |
| 7,827,646 | B2 * | 11/2010 | Pruett | 15/104.061 |
| 2003/0041400 | A1 * | 3/2003 | Knapp | 15/104.061 |
| 2003/0183022 | A1 | 10/2003 | Sapelnikov et al. | |
| 2007/0113362 | A1 | 5/2007 | Lino et al. | |
| 2008/0141474 | A1 | 6/2008 | Kapustin et al. | |
| 2010/0000037 | A1 * | 1/2010 | Pruett et al. | 15/104.061 |

* cited by examiner

PIPELINE CLEANING PIG WITH SELF-ENERGIZING DIAGONALLY ORIENTED SCRAPERS

REFERENCE TO PENDING APPLICATIONS

This application is not based upon any pending domestic or international patent applications.

FIELD OF THE INVENTION

The present invention relates to a mechanical pigging device. Such devices are commonly referred to in the industry simply as "pipeline pigs" or more briefly "pigs". The invention herein is a type of pipeline pig particularly used for cleaning purposes, that is, for moving through the interior of a pipeline by the force of fluid flow and during such movement to scrape and clean the interior wall of the pipeline.

BACKGROUND OF THE INVENTION

Pipelines have long been used for conducting liquids and gases from one location to another. With the advent of the petroleum industry, pipelines are commonly used for transporting hydrocarbon products and particularly for moving crude oil from field locations to refineries or where crude oil is moved for further delivery, such as by ships, tank cars and so forth. In addition to moving crude oil, pipelines are frequently employed in the petroleum industry for moving natural gas from production areas to gas plants and areas of consumption.

Whether moving hydrocarbon liquids or gases, there is a tendency for contaminants to adhere to the wall of the pipeline. As an example, crude oil frequently carries with it paraffin contents that tend to deposit on the pipeline interior walls. Further, since most pipelines are made of steel, rust has a tendency to form on interior pipeline walls.

For these and various other reasons, it is important for efficiency purposes that pipeline walls be periodically cleaned and this is most effectively accomplished by periodically scraping the interior walls of the pipeline.

The present invention is a scraping pig that is configured to be moved by fluid flow through a pipeline.

For additional information relating to this invention, reference may be had to the following previously issued United States patents.

| Pat. No. | Inventor | Title |
|---|---|---|
| 3,576,043 | Zongker | Pipeline Pig With Spring-Mounted Scrapers |
| 4,081,875 | Nishino | Scale Removal Device |
| 4,083,074 | Curtis | Multipurpose Pipeline Pig |
| 4,244,073 | Sagawa | Pipeline Pig |
| 4,603,449 | Knapp | Unitized Pig Body For Parafin Removal |
| 4,907,314 | Kershaw | Pipeline Pig |
| 5,379,475 | Sivacoe | Scraper For A Pipe Pig |
| 5,384,929 | Smith | Pig For Use In Cleaning The Interior Wall Of A Pipeline |
| 5,457,841 | Minton | Cleaning Pig For Pipeline Of Varying Diameter |
| 5,600,863 | Curran | Pipe Scraper Assembly |
| 6,038,725 | Knapp | Unicast Paraffin Removing Pipeline Pig Incorporating Multiple Diameter and Thickness Discs and Having A Central Bending Portion For Turns |
| 6,065,174 | Laymon | Parabolic Scraper For A Pipeline Pig |
| 6,145,150 | Knapp | Multi-Dimensional Pig Including Wiper Disk Permitting Passage Through |
| 6,276,017 | Lino et al. | Multisize Bidirectional Scraping Device |
| 6,308,363 | Lino et al. | Modular Multisize Bidirection Scraping Device |
| 6,792,641 | Laker | Pipeline Pig |
| 7,000,280 | Knapp | Aggressive Pipeline Pig |
| 2003/0041400 | Knapp | Molded Pipeline Pig With Hardness Variations |
| 2003/0183022 | Sapelnikov et al. | Sensors Carrier For In-Tube Inspection Scraper |
| 2007/0113362 | Lino et al. | Structured Foam Pig |
| 2008/0141474 | Kapustin et al. | Device For Cleaning Multidiameter Pipelines |

BRIEF SUMMARY OF THE INVENTION

The pipeline pig of this invention is used for cleaning the interior of a pipeline. The pipeline pig is formed by a longitudinal pig body. Forward and rearward elastomeric propulsion members are affixed to and serve to support the pig body substantially concentrically in a pipeline. Further, the propulsion members function to move the pig body through a pipeline by the force of fluid flow.

A plurality of spaced apart elastomeric scraper members radially extend from the pig body. Each scraper member has a semi-circular outer peripheral edge configured and dimensioned to compressibly engage the interior wall of the pipeline.

Preferably the scrapers are arranged in at least one plane perpendicular to a longitudinal axis of the pig body. Further the scrapers are configured and dimensioned so that their outer peripheral edges contact the pipeline full circumferential interior.

The scraper members can be made of a variety of semi-rigid materials, polyurethane being one ideal material.

The elastomeric propulsion members can be made with spaced apart small diameter holes resulting in some pipeline fluid bypassing the pig to assist in maintaining dislodged debris suspended in the pipeline fluid.

In one embodiment of the invention the scraper members are each individual members having an inner edge affixed to a longitudinal pig body that may be rigid or flexible. In another embodiment the scraper members are each molded into a central hub ring which is attached to the pig body.

This invention also includes the arrangement wherein the pig body is a structural member that includes a pair of brackets for each scraper member, the brackets being spaced apart in sets and wherein the inner end of each scraper member is supported between a pair of brackets.

In a preferred embodiment of the invention a pipeline pig has propulsion members that are each in the form of an elastomeric disc or cup of external diameter substantially equal to the internal diameter of the pipeline.

This invention provides a self-energized pipeline pig for scraping and cleaning the interior of a pipeline, the pig having a plurality of elastomeric scraper members extending radially from a pig body and propulsion means are secured to the pig body for moving the pig body in the pipeline by the force of fluid flow and in which each scraper member has an outer circumferential end of diameter corresponding closely to that of the pipeline interior.

Further objects and features of the present invention will be apparent to those skilled in the art upon reference to the accompanying drawings and upon reading the following description of the preferred embodiments.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENTS

It is to be understood that this invention is not limited in its application to the details of construction and arrangement of parts illustrated in the accompanying drawings. The invention is capable of other embodiments and of being practiced or carried out in a variety of ways. The phraseology and terminology employed herein are for the purpose of description and not of limitation.

Elements shown by the drawings are identified by the following numbers:

| | |
|---|---|
| 10 | Longitudinal pig body |
| 12 | Forward radial circumferential flange |
| 14 | Angular braces |
| 16 | Rearward radial circumferential flange |
| 18 | Forward elastomeric propulsion member |
| 20 | Rearward elastomeric propulsion member |
| 24 | Smaller reinforcing ring |
| 26 | Bolts |
| 28 | Nuts |
| 32 | Smaller reinforcing ring |
| 36 | End plate |
| 38 | Pull eye |
| 40 | Bypass holes |
| 42 | Forward group of scraper members |
| 44 | Rearward group of scraper members |
| 46 | Radial elastomeric scraper |
| 48 | Outer circumferential edge surface |
| 50 | Leading edge surface |
| 52 | Following edge surface |
| 54 | Planar front surface |
| 56 | Planar rear surface |
| 58 | Inner circumferential edge surface |
| 60 | Bolt holes |
| 62 | Bolts |
| 63 | Nuts |
| 64 | Forward bracket |
| 66 | Rearward bracket |
| 68 | Angle braces |
| 70 | Forward hub |
| 72 | Rearward hub |
| 74 | Forward ring |
| 76 | Rearward ring |
| 78 | Bolts |
| 84 | Bevel |

Figure 1:
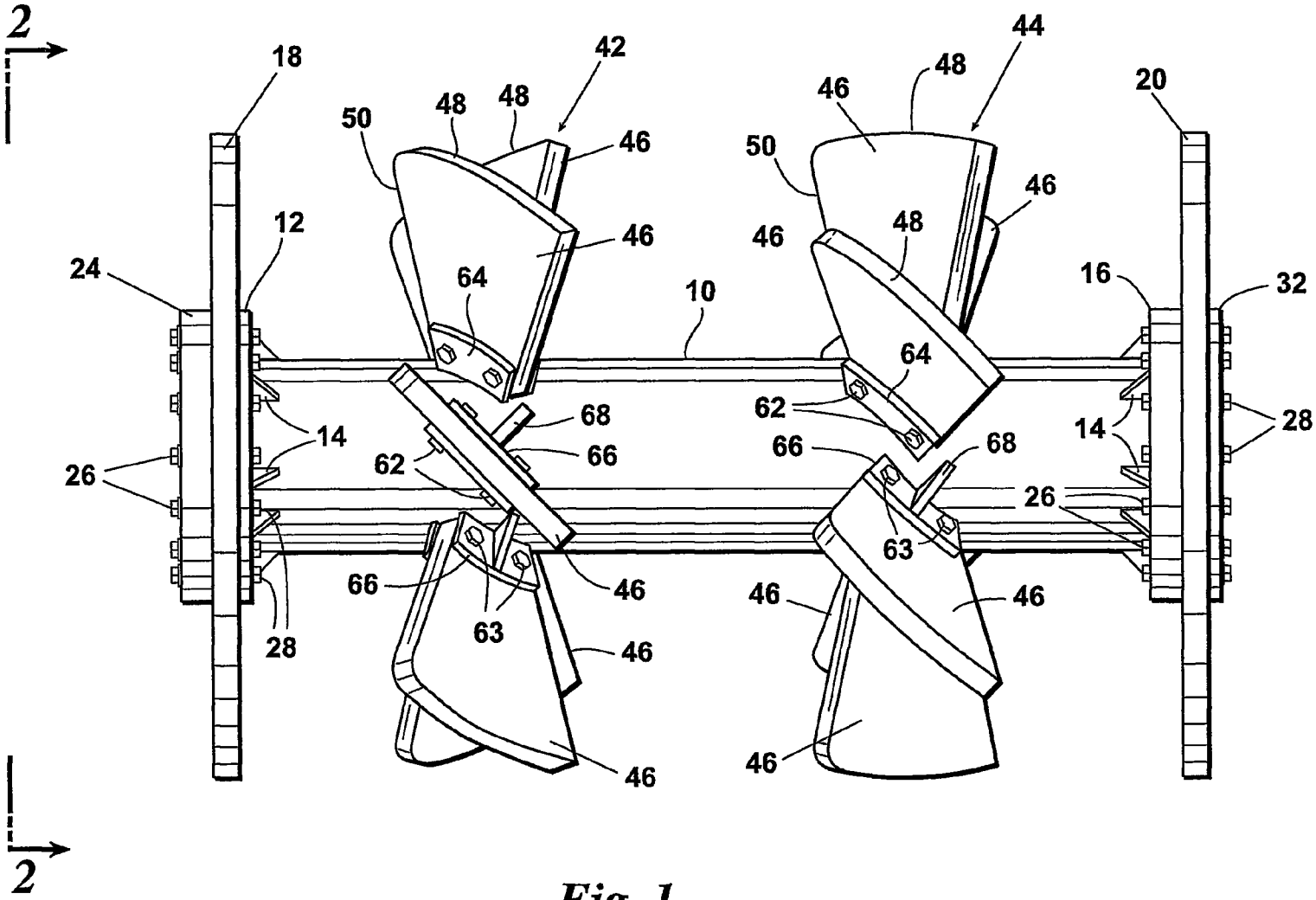
FIG. 1 is an elevational external view of a pipeline scraping pig of this invention ready to be inserted into a pipeline to move through the pipeline by the force of fluid flow to scrape the internal walls of the pipeline.
Figure 6:
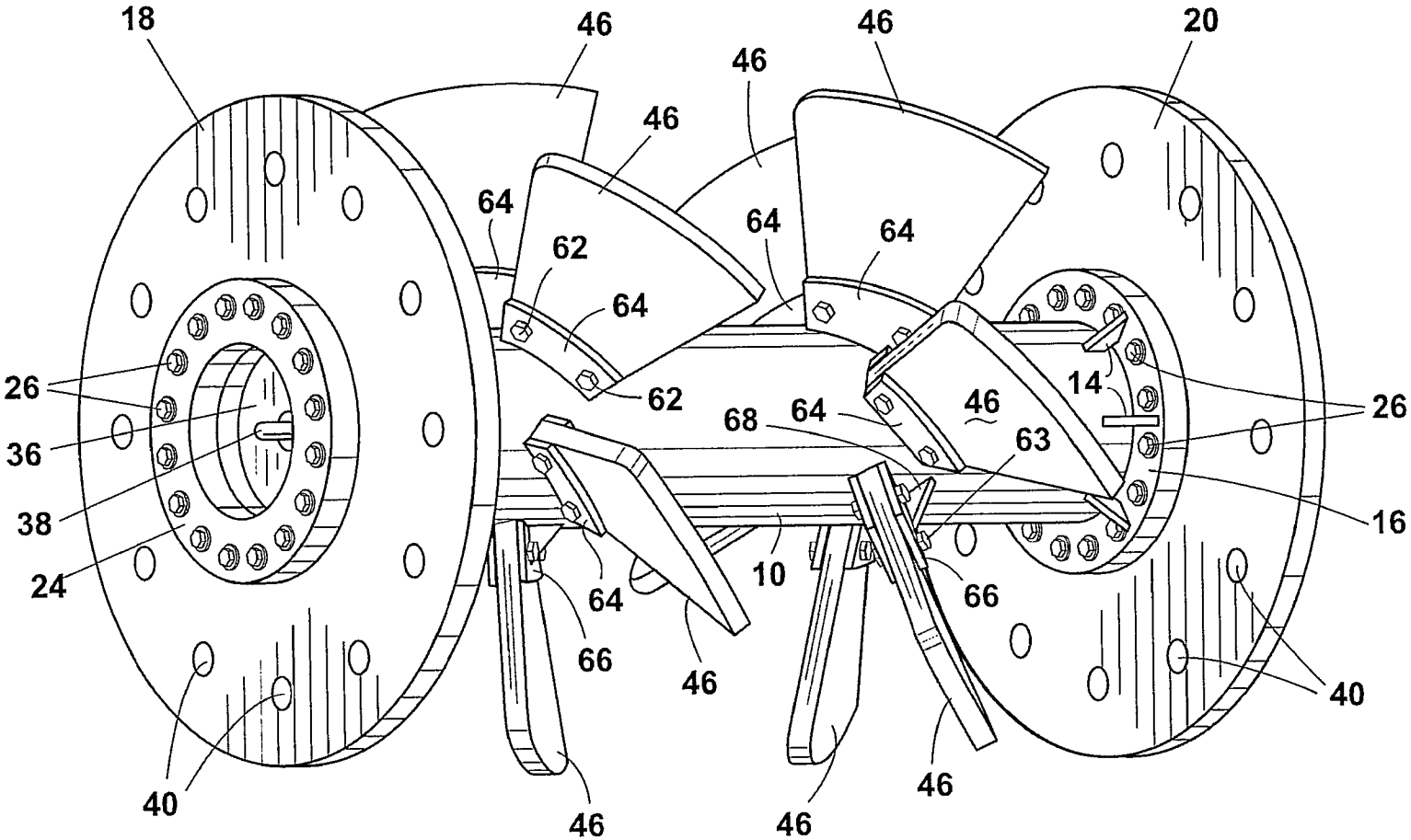
FIG. 6 is an isometric view of the pipeline pig of FIG. 1 in a form and shape as it is ready to be positioned within the interior of the pipeline.

Referring to the drawings and first to FIGS. 1 and 6, a first embodiment of the invention is illustrated. FIG. 1 is an external elevational view of a completed pig with diagonally oriented scrapers while FIG. 6 is an external isometric view of the pig. As shown in FIGS. 1 and 6, a basic element of the pipeline scraping pig of this invention is a longitudinal pig body 10. At a forward end of the longitudinal pig body 10 there is a forward radial circumferential flange 12 structurally supported by angular braces 14. The forward radial circumferential flange 12 that extends around the parameter of longitudinal pig body 10 and angular braces 14 are preferably welded to the exterior of pig body 10.

In like manner, there is a rearward radial circumferential flange 16 that is affixed and radially extends from a rearward end of pig body 10, the rearward radial circumferential flange 16 also being supported by angular braces 14 that can be welded to the exterior of longitudinal pig body 10.

Supported on the exterior of the forward end of pig body 10 is a forward elastomeric propulsion member 18. The propulsion member 18 may be an integral toroidal elastomeric plate member positioned on the exterior of a forward end of longitudinal pig body 10.

In like manner a rearward radial circumferential elastomeric propulsion member 20 is mounted on the rearward end of longitudinal pig body 10.

Referring again to FIGS. 1 and 6 there is shown at the forward end of longitudinal pig body 10 a smaller diameter toroidal reinforcing ring 24, preferably made of metal and retaining the elastomeric propulsion member 18. Bolts 26, the heads of which are seen in FIGS. 1 and 6, extend through the smaller reinforcing ring 24, the forward elastomeric propulsion member 18 and the forward radial circumferential flange 12. Bolts 26 are retained by nuts 28.

The rearward elastomeric propulsion member 20 is secured to pig body 10 in substantially the same way as the forward elastomeric propulsion member is secured, that is, by the provision of a smaller reinforcing ring 32. Bolts 26, the heads of which are seen in FIG. 1 and nuts 28 seen in FIGS. 1 and 6 retain the rearward elastomeric propulsion member 20 extending radially of pig body 10.

Figure 8:
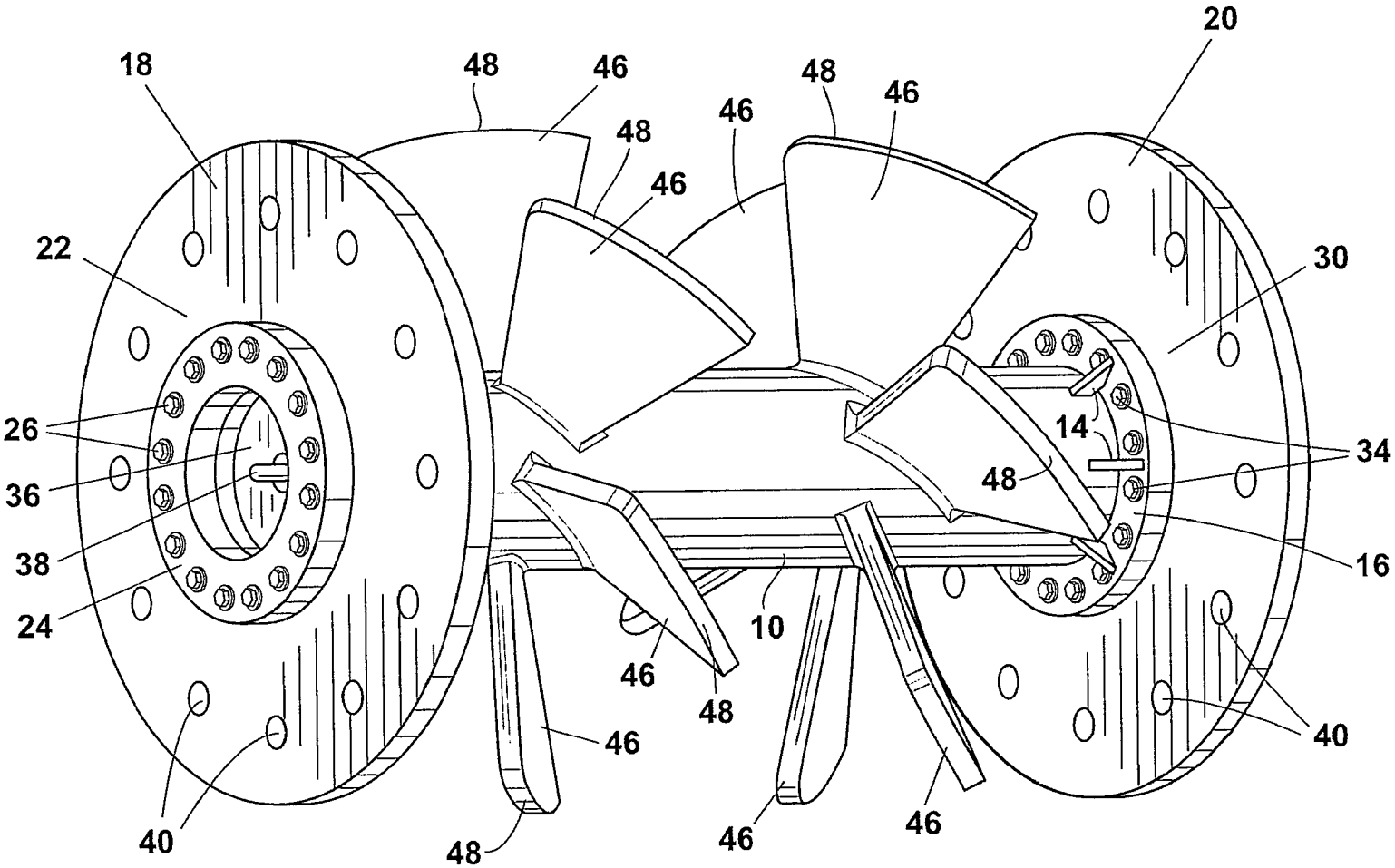
FIG. 8 is an isometric view as shown in FIGS. 6 and 7 but showing still a different method of mounting the scraper member to the longitudinal body.

The internal passageway of longitudinal pig body 10 (best formed of a length of pipe) is closed as seen in FIGS. 6 and 8 by an end plate 36 which typically might be a circular plate welded to or within the forward end of pig body 10. A pull eye 38 having a forward open loop is secured, such as by welding, to end plate 36. While not seen in the drawings, the rearward end of longitudinal pig body 10, when made of pipe as is the preferred embodiment, is open ended.

The diameters of forward elastomeric propulsion member 18 and rearward elastomeric propulsion member 20 are configured and dimensioned to closely fit the interior of the pipeline for which the pig is designed so that when the pig is positioned in a pipeline the propulsion members substantially close fluid flow through the pipeline to ensure that as fluid moves in the pipeline the pipeline scraping pig is moved by the fluid flow to traverse the interior of a pipeline. The elastomeric propulsion members can be made with spaced apart small diameter holes resulting in some pipeline fluid bypassing the pig to assist in maintaining dislodged debris suspended in the pipeline fluid.

As seen in FIGS. 1 and 6, a most important part of the pipeline scraping pig of this invention is a plurality of spaced apart elastomeric scrapers radially extending from the pig body. In the arrangement illustrated in FIGS. 1 and 6 the diagonally oriented scrapers are arranged in a forward group generally indicated by the numeral 42 and a rearward group generally indicated by the numeral 44. Each group includes a number of spaced apart radial diagonally oriented scrapers 46. In the illustration, in FIGS. 1 and 6 each of groups 42 and 44 include eight radially extending diagonally oriented scrapers 46. Each diagonally oriented scraper 46 functions like a plow to shave off debris from a pipeline interior wall.

Figure 5:
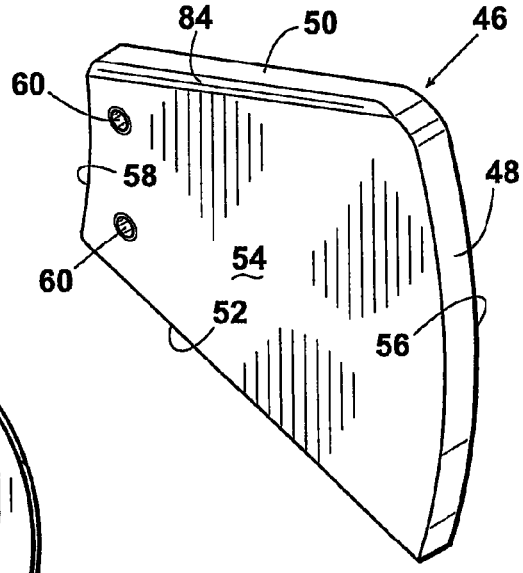
FIG. 5 is an external isometric view of the scraper shaped members as used in formulating the pipeline pig of this invention.
Figure 4:
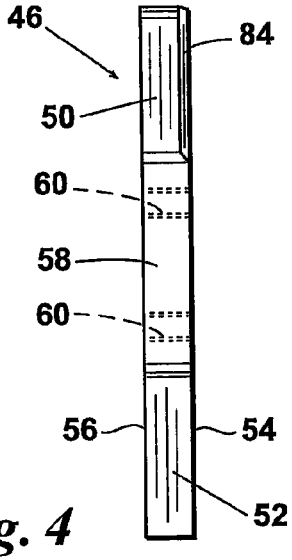
FIG. 4 is an external end view of a larger end of a radial elastomeric scraper as used in the pipeline pig of this invention.
Figure 3:
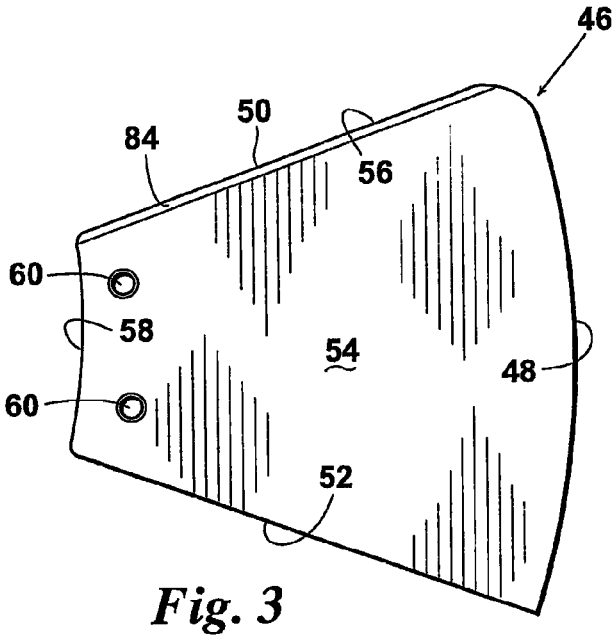
FIG. 3 is an elevational external view of a scraper member as used as a part of the pipeline pig of this invention.

FIGS. 3, 4 and 5 show in detail the configuration of each of the radially extending diagonally oriented scrapers 46. Each scraper 46 is formed of an elastomeric sheet of material, such as polyurethane, of sufficient thickness to be substantially rigid and yet free to flex as necessary to accommodate deviations in the internal configurations of a pipeline and yet, each provides an outer circumferential edge surface 48. Each scraper therefore has, in addition to the outer circumferential edge surface 48, a leading longitudinal edge surface 50 and a following longitudinal edge surface 52. Each radial diagonally oriented scraper 46 has a planar front surface 54 and a planar rear surface 56. At the end opposite of the outer circumferential edge surface 48, each scraper is defined by an inner circumferential edge surface 58 that abuts against the exterior of pig body 10 as the radial diagonally oriented scrapers are mounted to the pig body. Adjacent the inner circumferential edge surface 58 and extending between the planar front and rear surfaces 54, 56 of each elastomeric scraper 46 has a pair of bolt holes 60. These bolt holes 60 receive bolts 62 by which the radial diagonally oriented scrapers 46 are retained on pig body 10. Each of bolts 62 is retained by a nut 63.

Each of the radial diagonally oriented scrapers 46 is secured to pig body 10 to extend radially therefrom whereby a plane of each scraper is at an angle of between 15° and 75° relative to a plane of a longitudinal axis of pig body 10. As shown in FIGS. 1 and 6, the inner end of each of the radial scrapers is secured between a forward bracket 64 and a rearward bracket 66. There is a set of brackets for each scraper. Each of the brackets 64, 66 has an arcuate inner surface that conforms to the external circumferential surface of pig body 10. Each of the brackets 64, 66 has two openings therein. The bolts 62 and nuts 63 serve to clamp the brackets 64 to the exterior of each of the elastomeric scrapers 46.

The inner arcuate edge of each of bracket 66 can be secured to pig body 10 such as by welding. Further, to rigidly secure the radial extension of each of the elastomeric scrapers, each rearward bracket 66 has an angular brace 68 which is also preferably welded to the exterior of pig body 10.

The diagonally oriented scrapers 46 are dimensioned to be oversized for the dimensions of the interior wall of a pipeline for which the scraper pig is intended to be used. Thus the scrapers have outwardly extending memory and act like an oversized spring to cause their outer circumferential edge surface 48 to firmly engage a pipeline interior wall surface. In this way the pipeline scraping pig of this invention is self-energized.

Figure 2:
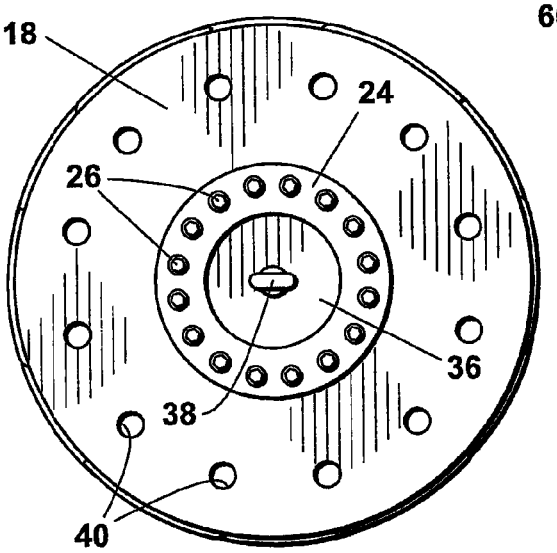
FIG. 2 is an elevational external view taken along the line 2-2 of FIG. 1 showing the forward end of the pipeline scraping pig.
Figure 7:
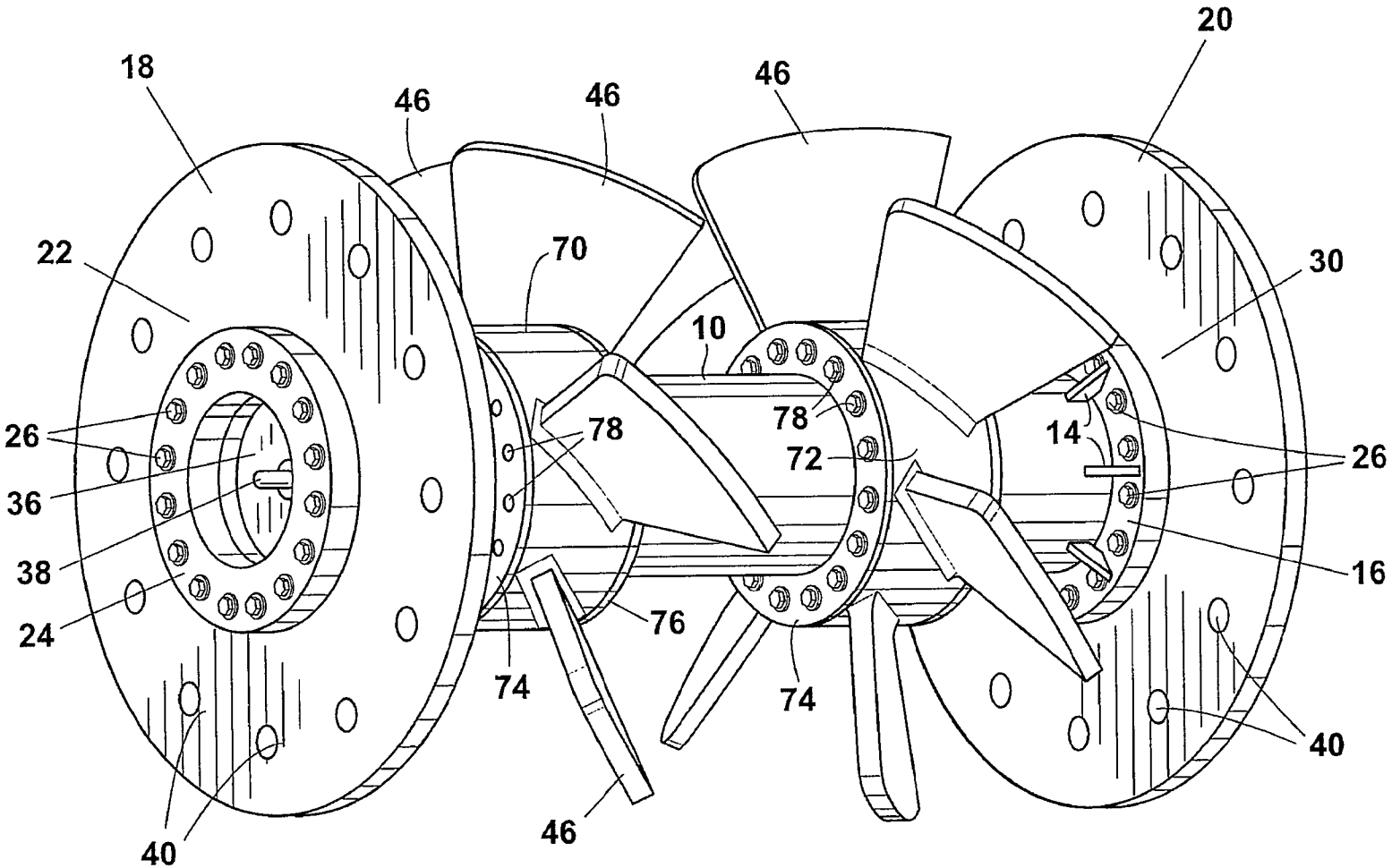
FIG. 7 is an external isometric view showing an alternate embodiment of the invention showing an arrangement for mounting the scraper members in hubs that are secured to the longitudinal pig body.

FIG. 7 shows an alternate embodiment of the invention which is different than FIGS. 1 and 2 only in the way the radial diagonally oriented scrapers 46 are mounted to the exterior of pig body 10. In FIG. 7 a pair of integral hubs and scrapers are employed for securing the diagonally oriented scrapers to the pig body. Specifically, there is a forward hub 70 and a rearward hub 72. Hubs 70 and 72 are cylindrical and of external diameter greater than the external diameter of pig body 10. Each of the hubs 70, 72 are mounted between a forward ring 74 and a rearward ring 76, each of the rings having spaced apart bolts. By means of bolts 78 extending through rings 74 and 76 are secured to hubs 70 and 72. The internal circumference of each of the rings 74 and 76 is configured to engage the external circumferential surface of pig body 10.

FIG. 8 shows another alternate embodiment that is different from the structures illustrated in FIGS. 1 and 6 only in the method of securing the radial diagonally oriented scrapers 46 to the pig body. In the arrangement of FIG. 8, the body 10 and diagonally oriented scrapers 46 may be one integral molded part or fabricated from a tubular body and diagonally oriented scrapers.

Various means of securing the diagonally oriented scrapers to longitudinal pig body 10 are illustrated in FIGS. 6, 7 and 8. These illustrations are exemplary of the fact that the diagonally oriented scraper 46 may be attached to the pig body in a variety of ways. Any method of extending diagonally oriented scrapers radially of a pig body and at an angle to a plane of the axis of the pig body would be within the scope of this invention.

The arrangement of this invention provides a pig with pipeline cleaning self-energized diagonally oriented scrapers. The pig as described herein, when placed in a pipeline having fluid flow therethrough, will move through the pipeline by the force of the fluid flow. The outer circumferential edge surfaces 48 of each of the radial elastomeric scrapers engages the interior surface of the pipeline and scrapes loose encrustations, paraffin and other debris that tends to collect in the pipeline. The scraped debris is moved forward by the movement of the pig through the pipeline and by the force of fluid flow.

The pig functions to provide rotational energy by the provision wherein the rate of fluid flow exceeds the rate of movement of the scraping pig. This is accomplished by the propulsion members 18 and 20 have bypass holes 40 therethrough which permits a certain percent of the pipeline fluid to flow past the scraping pig as the scraping pig is moved through the pipeline. The flow rate of the pipeline fluids being greater than the pig means that the movement of fluid against the diagonally oriented scrapers imparts rotary motion so the cleaning pig not only propelled through the pipeline but is concurrently rotated within the pipeline to augment cleaning action.

The essence of the invention is a pipeline pig having diagonally oriented scrapers each having an outer edge that engages the interior surface of a pipeline as the pig is moved through the pipeline and wherein the scraping action is obtained by the diagonally oriented radially scrapers having outer edges that scrape against the interior surface as the cleaning pig is moved by fluid flow through the pipeline. A unique aspect of the invention is the provision of a pipeline cleaning pig that moves laterally through the pipeline and provides diagonally oriented scrapers to augment cleaning action wherein the outward force on the scraper is accomplished without any mechanical elements.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. A pipeline pig for cleaning the interior wall of a pipeline, the pipeline pig comprising:

a longitudinal pig body;

forward and rearward elastomeric propulsion members affixed to and supporting said pig body substantially concentrically in a pipeline and functioning to move said pig body through a pipeline by the force of fluid flow; and a plurality of spaced apart elastomeric scrapers diagonally oriented relative to a plane of a longitudinal axis of said pig body and capable of imparting rotational motion to said pig body and radially extending from said pig body, each said scrapers having an inner circumferential edge surface that abuts against the exterior of said pig body and a semi-circular outer peripheral edge configured and dimensioned to compressibly engage an interior wall of a pipeline.

2. A pipeline pig according to claim 1 wherein said scrapers are diagonally oriented at an angle in a range of 15° to 75° relative to the vertical plane of the longitudinal axis of said pig body.

3. A pipeline pig according to claim 2 wherein said scrapers are configured and dimensioned so that said outer peripheral edges contact an opposing pipeline full circumferential interior.

4. A pipeline pig according to claim 1 in which said scrapers are made of polyurethane.

5. A pipeline pig according to claim 1 in which said elastomeric propulsion members have spaced apart small diameter holes therethrough whereby some pipeline fluid bypasses the pig to assist in maintaining dislodged debris suspended in the pipeline fluid.

6. A pipeline pig according to claim 1 in which said scrapers are each individual members having an inner edge affixed to a longitudinal pig body.

7. A pipeline pig according to claim 1 in which said scrapers are each molded into a central hub ring which is attached to said pig body.

8. A pipeline pig according to claim 1 in which said pig body, said propulsion members and said scrapers are integrally fabricated as a unitary elastomeric member.

9. A pipeline pig according to claim 1 wherein said pig body is a structural member and including a pair of brackets for each said scraper, said brackets being spaced apart in pairs and wherein each scraper is supported between said pair of brackets.

10. A pipeline pig according to claim 1 wherein said propulsion members are each in the form of an elastomeric disc or cup of external diameter substantially equal to the internal diameter of the pipeline.

11. A pipeline pig according to claim 1 wherein each said scrapers and said propulsion members are both made of polyurethane.

12. A pipeline pig according to claim 1 wherein each said scrapers has an outer circumferential end of diameter that conforms to that of the pipeline interior.

13. A pipeline pig for cleaning the interior wall of a pipeline, the pipeline pig comprising:

a plurality of spaced apart elastomeric scrapers diagonally oriented about a body of the pipeline pig so that a planar face surface is impinged upon by a pipeline product flow at a rate of pipeline product flow above that of the pipeline pig;

the planar face surface of each scraper being dimensioned to span the distance between an exterior surface of the pipeline pig and the interior wall of a pipeline;

wherein the plurality of spaced apart elastomeric scrapers is a means for imparting the rotary motion to the pipeline pig.

14. A pipeline pig for cleaning the interior of a pipeline, comprising:

a longitudinal pig body;

forward and rearward elastomeric propulsion members affixed to and supporting said pig body substantially concentrically in a pipeline and functioning to move said pig body through a pipeline by the force of fluid flow; and a plurality of spaced apart elastomeric scrapers affixed to the longitudinal axis of said pig body and radially extending away from said pig body, each said scrapers having a leading edge and a following edge, wherein the leading and following edges are arranged diagonal to the propulsion members;

wherein each said scrapers require no mechanical means to provide compressible engagement with an opposing interior wall of a pipeline.

15. A pipeline pig according to claim 14 wherein said scrapers impart rotary motion to the pipeline pig.

16. A pipeline pig according to claim 1 wherein each said scrapers require no mechanical means to provide compressible engagement with an opposing portion of the interior wall of the pipeline.

17. A pipeline pig according to claim 1 wherein each said scrapers include a planar face surface which spans the distance between an external surface of the pig body and said outer peripheral edge.

18. A pipeline pig according to claim 13 wherein the external surface is a bracket, each said bracket securing a respective inner edge of one of each said scrapers to said pig body.

19. A pipeline pig according to claim 13 wherein each said scrapers require no mechanical means to provide compressible engagement with an opposing portion of a pipeline wall.

20. A pipeline pig according to claim 13 wherein the external surface is a bracket mounted to said pig body, each said bracket securing a respective inner edge of one of each said scrapers to said pig body.

* * * * *